United States Patent [19]

Mergler et al.

[11] 3,952,572

[45] Apr. 27, 1976

[54] BEAM BENDER

[75] Inventors: Harry W. Mergler, Westlake; Daniel K. Wright, Cleveland Heights; Thomas P. Kicher, South Euclid; Michael Savage, Cleveland; Wieslaw Kosc, Parma, all of Ohio

[73] Assignee: Case Western Reserve University, Cleveland, Ohio

[22] Filed: Jan. 23, 1974

[21] Appl. No.: 435,713

[52] U.S. Cl. ..... 72/298; 72/305; 72/308; 72/319

[51] Int. Cl.[2] ..... B21D 11/04; B21D 7/03

[58] Field of Search ..... 72/295–298, 72/305, 308–310, 316, 318, 319, 369, 387, 388, 457, 458

[56] References Cited

UNITED STATES PATENTS

| | | | |
|---|---|---|---|
| 1,804,384 | 5/1931 | Miller | 72/298 |
| 2,228,448 | 1/1941 | Fader | 72/319 |
| 2,316,049 | 4/1943 | Connor | 72/295 |
| 2,318,344 | 5/1943 | Urschel | 72/297 |
| 3,430,478 | 3/1969 | Arnold | 72/298 |
| 3,673,844 | 7/1972 | Heijenga | 72/298 |
| 3,731,513 | 5/1973 | Kindermann et al. | 72/295 |

*Primary Examiner*—C. W. Lanham
*Assistant Examiner*—E. M. Combs
*Attorney, Agent, or Firm*—McNenny, Farrington, Pearne & Gordon

[57] ABSTRACT

A method and apparatus for bending beams by which a beam is subjected to pure moment bending in a critically oriented plane to avoid twist and to maintain single plane bending in a beam of arbitrary cross section. As disclosed, a pair of bending heads laterally engage a beam at longitudinally spaced points. Force actuator means connected directly between the heads is energized to rotate one of the heads relative to the other to produce a bending moment in a work area in the beam between the heads. The actuator means is arranged to produce a force couple on the heads which avoids transverse loading of the beam and resultant twist and which is adapted to selectively orient the plane of the applied couple relative to the desired bending plane to maintain single plane bending in beams of nonsymmetric cross section.

16 Claims, 16 Drawing Figures

10
11
12
14
15
18
25
28
31
32
33
34
37
38
40
41
48
51
52
53
54
55
56
57
60
61
62
64
65
67
68
69
70
73
74
80

13
14
15
25
26
27
28
31
33
38
39
41
43
44
45
47
51
52
53
54
55
56
60
61
62
64
65
67
73
74
79
80
4

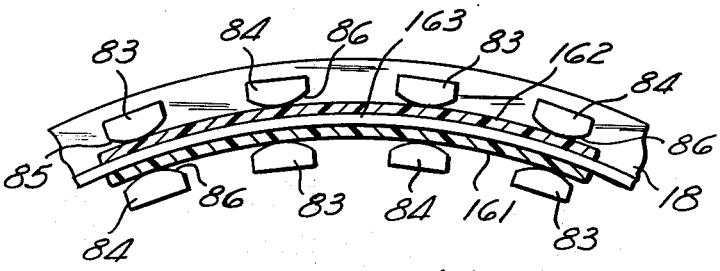
Fig. 11
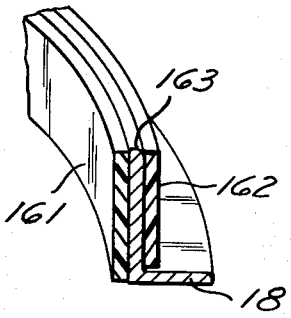
Fig. 12
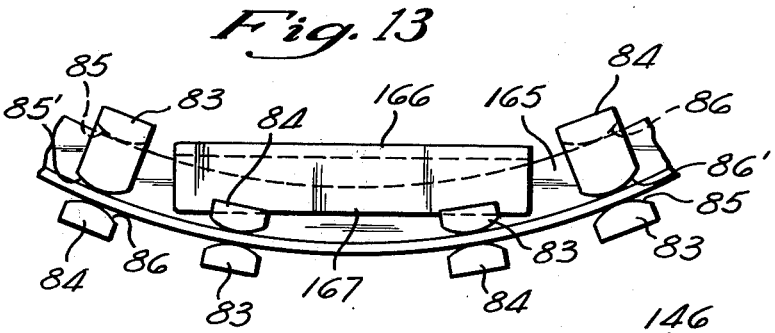
Fig. 13
Fig. 14
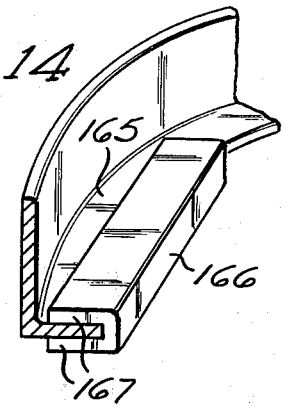
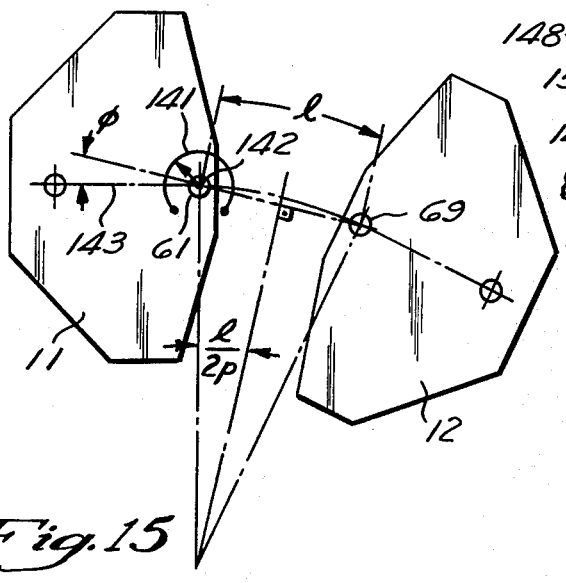
Fig. 15
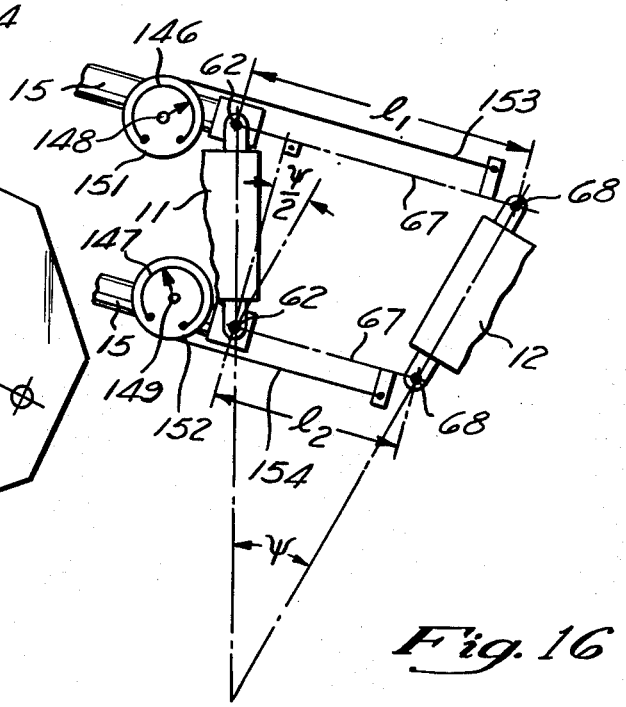
Fig. 16

BEAM BENDER

The United States Government has rights in this invention persuant to Grant GL-35994 awarded by the National Science Foundation.

BACKGROUND OF THE INVENTION

The invention relates to improvements in methods and apparatus for bending beams or like objects to a desired profile.

DESCRIPTION OF THE PRIOR ART

Among the various fields of use, the invention has application in the bending of ship beams or rib frame members from straight mill products to prescribed profiles. Alternatively, the invention may be used to straighten distorted beams or other elongated members. In prior techniques, a beam is usually bent in a three-point loading system where the beam is laterally supported by a pair of spaced elements while an opposed third ram element advances laterally against the beam midway between the spaced support elements until the beam is plastically bent to a desired angle.

Inherent in this widely used approach is the introduction of transverse loading or shear throughout the stressed zone of the beam between the spaced support elements. The transverse loading may develop a permanent twist in a beam of nonsymmetrical cross section, which is objectionable for numerous reasons. Twisting of an otherwise plane beam profile makes handling, supporting, and measurement of the beam during bending operations difficult. Further, beams twisted out of plane are not readily stacked for storage or transport and, more critically, are difficult to properly align during their fabrication into a hull assembly.

Another result of the stress distribution in a three-point loading system is a nonuniform bending moment in the work area of the beam between the support elements which reaches a maximum at the center ram. Under this condition, the beam yields principally at the ram and develops what is termed a plastic hinge where excessive strains are produced in a limited area. This local type of permanent deformation is generally characterized by unpredictable material behavior in terms of the relationship between load and deformation and in terms of spring-back. The resulting curvature produced in the work area of the beam is nonuniform along its length and may be visualized as a central, sharply curved area of relatively small radius and adjacent, relatively straight areas. This kinked shape is not readily superposed with a smoothly curved profile. Thus, where a beam is successively bent along its length to conform to a given profile, substantial compromise must be made with deviations from the profile, and/or smaller and more frequent bends must be made.

A problem commonly occurs with the bending of beams of nonsymmetric cross section where the lack of geometrical balance about the desired bending plane requires, for force equilibrium conditions, a bending moment or component perpendicular to the principal applied moment to maintain the beam in a plane. Typically in commercial practice, either this requirement is ignored or the beam is restrained from bending out of the principal plane by a rigid constraint during bending operations. Unfortunately, such passive restraint by fixed or guided surfaces usually allows a residual of as much as 10 percent out-of-plane bending when the beam is released. Where this bending in a secondary plane is severe enough to be unacceptable, the beam may have to be reworked by repositioning it in the bending apparatus and applying a correcting moment in the secondary plane. Reworking of the beam reduces production efficiency, and may detrimentally affect the accuracy of the originally produced curve in the principal plane.

SUMMARY OF THE INVENTION

The invention provides a method and means by which a beam may be subjected to a pure bending moment without introduction of transverse loading to thereby avoid problems of beam twisting and plastic hinge deformation. The condition of pure bending stress developed in a work area of the beam produces a uniform bend of substantially constant curvature. Further, the result is more predictable in relation to the forces and displacements to which the beam is subjected than that achieved by previously known methods. Also provided by the invention are a method and means for varying the orientation of a resultant bending moment plane to the geometric planes of a given cross section to avoid unwanted out-of-plane bending in beams of nonsymmetric cross section.

In the preferred embodiment, the beam is operated on by a pair of longitudinally spaced bending heads which develop a pure bending moment in an intermediate work area of the beam to plastically deform it to a desired contour. Force actuators connected to the heads produce bending moments in a principal longitudinal plane corresponding to the desired plane of bending and in a secondary longitudinal plane perpendicular to the principal plane for eliminating unwanted bending out of the principal plane. The force actuators, as disclosed, are of a linear motor type and are connected between the heads in primary and secondary pairs.

The actuators of each pair are coplanar with the beam and generally parallel to each other and the longitudinal beam axis or its chord. During operation, each actuator pair produces opposite forces of equal magnitude to generate force couples in their respective principal and secondary planes. By varying the relative magnitude of the force couples developed by the primary and secondary force actuators, a resultant couple is readily oriented relative to the geometric planes of a nonsymmetric beam to avoid out-of-plane bending.

Various other features and aspects of the invention are set forth below in connection with the description of a preferred embodiment of the invention.

BRIEF DESCRIPTION OF THE DRAWINGS

FIG. 11 illustrates support means for preventing buckling of a compressed beam portion which extends out of the desired plane of bending;

FIG. 12 is a longitudinal view of the beam and support means of FIG. 11;

FIG. 13 illustrates support means for preventing buckling of a compressed beam portion which extends in the plane of bending;

FIG. 14 is a longitudinal view of the beam and support means of FIG. 11;

FIG. 15 is a schematic diagram illustrating the geometry of the bending apparatus during bending in the principal plane; and FIG. 16 is a schematic diagram illustrating the geometry of the bending apparatus during bending in the secondary plane.

DESCRIPTION OF THE PREFERRED EMBODIMENT

Figure 1:
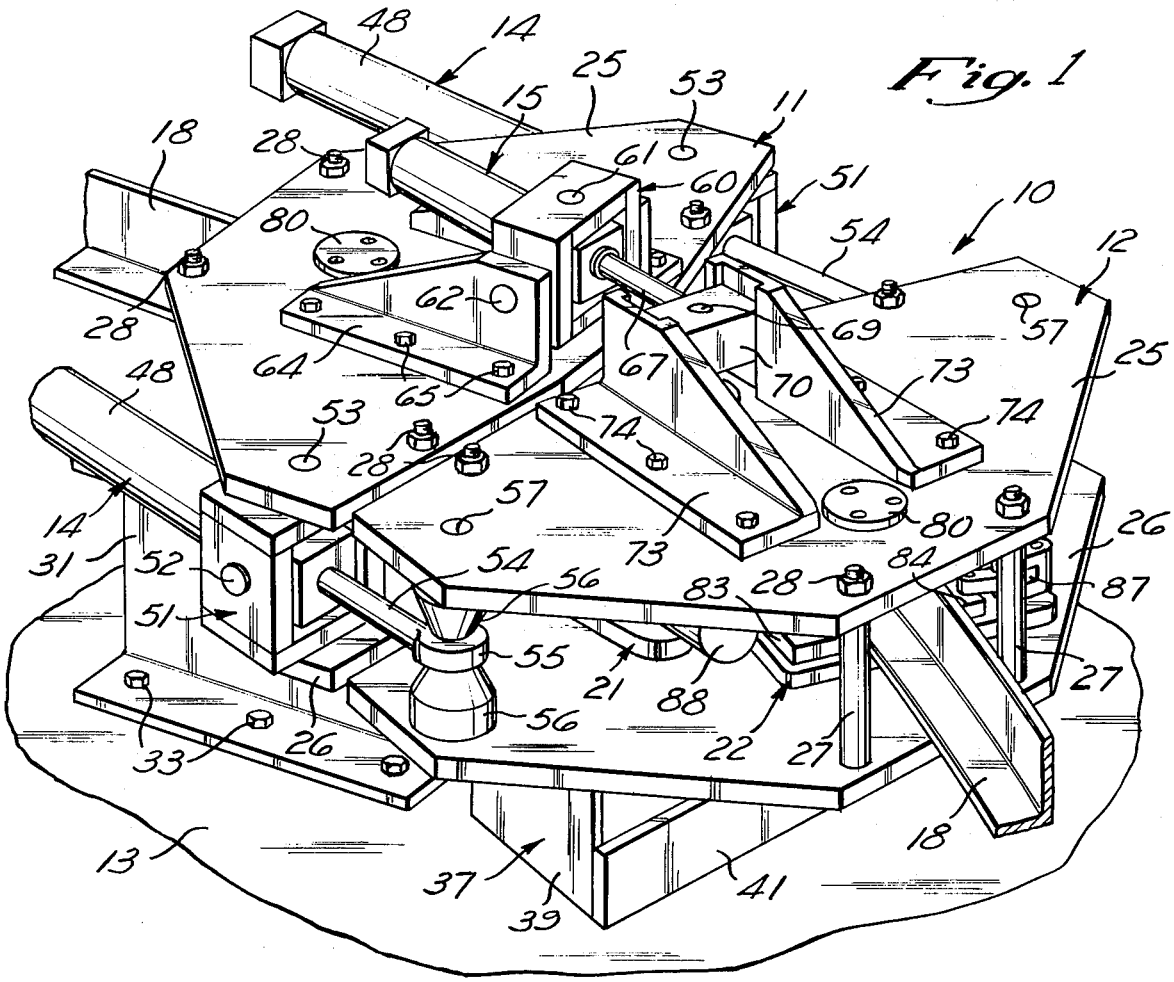
FIG. 1 is a perspective view of an apparatus for bending beams in accordance with the principles of the invention.
Figure 6:
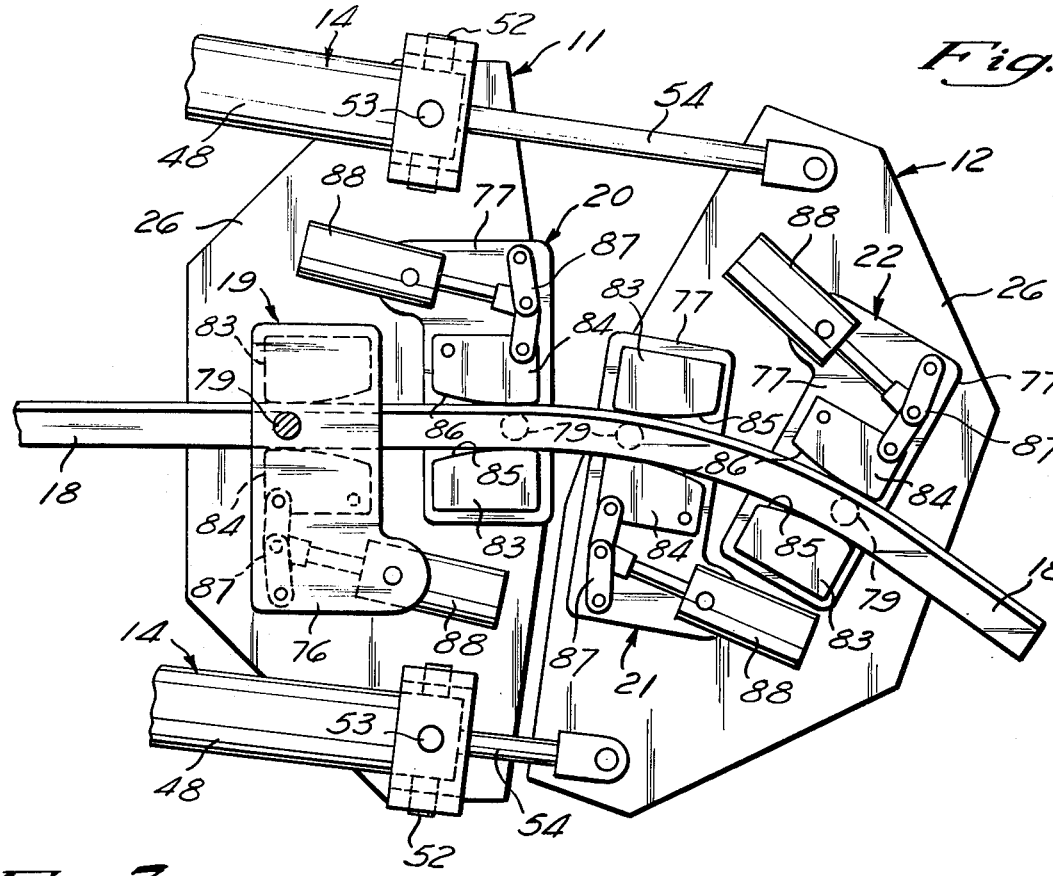
FIG. 6 is a schematic plan view similar to FIG. 2, with the top plates of a pair of bending heads of the apparatus removed to reveal beam clamping assemblies.

Apparatus, indicated generally at 10 in FIG. 1, for bending beams or other elongated members in accordance with the invention includes a pair of head assemblies 11 and 12. As viewed in the figures, the rightward head 12 is movable with respect to the leftward head 11, which is conveniently fixed to a floor or other supporting base 13. The head assemblies 11 and 12 are connected and are driven by a pair of primary actuators 14 and a pair of secondary actuators 15. A beam 18 extends longitudinally through the head assemblies 11 and 12, and is transversely gripped in each of the heads by associated sets of clamping assemblies 19 through 22 (FIG. 6).

For the sake of design simplicity, the movable and fixed bending head assemblies 11 and 12 are of substantially the same arrangement. Each head 11 and 12 comprises a pair of horizontally spaced, parallel plates 25 and 26 of steel or like structural material. Here, as well as in the description below, it is assumed that the apparatus 10 is arranged generally in a horizontal attitude with the plates 25 and 26 defining a horizontal plane, but it will be understood that other orientations may conceivably be used. The upper and lower plates 25 and 26 are maintained in parallel relation and are secured together by a plurality of vertical posts 27 and threaded nuts 28 at outer faces of the plates 25 and 26.

The fixed head assembly 11 is supported on the base 13 by a pair of laterally spaced channels 31 and 32 fixed to the base 13 by bolts 33 and to the outer or lower face of the associated lower plate 26. A spacer plate 34 (FIG. 2) is welded or otherwise secured between the channels 31 and 32 just above the plane of the base 13.

Figure 4:
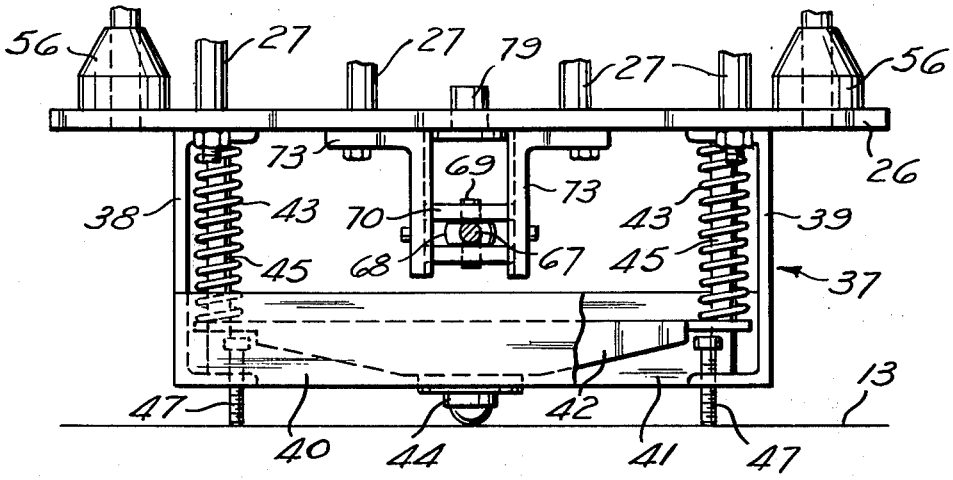
FIG. 4 is a fragmentary, elevational view taken in a longitudinal direction indicated by the line 4—4 of FIG. 3 and illustrating details of a support carriage.

The movable head assembly 12 is vertically supported by a carriage structure 37 shown in elevation in FIG. 4. The carriage structure includes a pair of laterally spaced, inturned channel members 38 and 39, welded or otherwise secured to the lower, outer face of the lower bending head plate 26. The longitudinal ends of the channels 38 and 39 are connected adjacent their lower portions by a pair of cross braces 40 and 41. A suspension plate 42 vertically supports the load of the movable head 12 through a pair of laterally spaced compression springs 43. A spherical roller and housing assembly 44 vertically supports the suspension plate 42 on the base 13, with negligible friction during movement of the head assembly 12.

Figure 3:
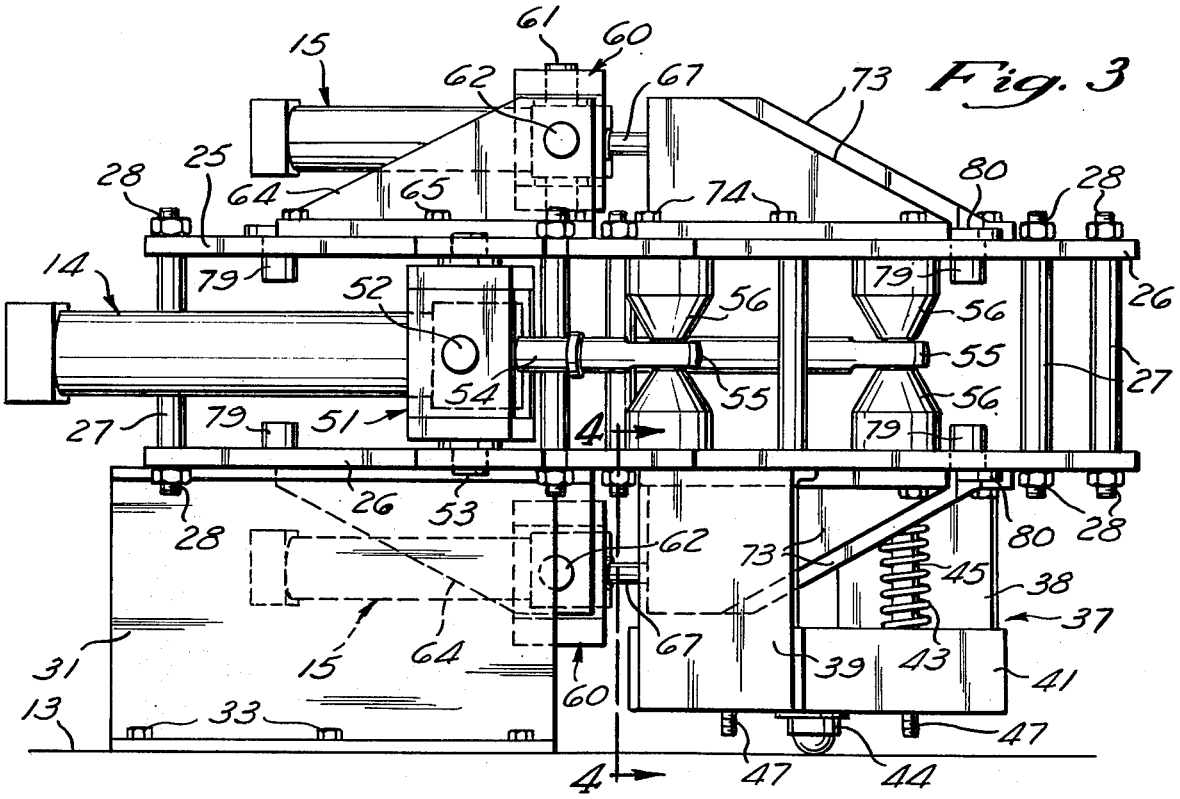
FIG. 3 is a side elevational view of the beam bending apparatus of FIG. 1.

The springs 43 are proportioned to support the associated head assembly 12 at the proper height above the base 13 and allow for slight vertical movement of the head assembly when it is tilted out of the horizontal plane. A pair of spaced, vertical guides 45 within the compression springs 43 are fixed within the flanges of the associated channels 38 and 39. The guides extend through aligned holes (not shown) in the support plate 42 to thereby vertically guide the latter so that vertical movement of the head assembly 12 is accommodated by either compression or extension of the compression springs 43. A set of bolts 47 threaded in the lower flanges of the channels 38 and 39 are provided to initially align the movable head 12 vertically and in a horizontal plane relative to the stationary head 11. During operation of the apparatus 10, the bolts 47 are retracted, as seen in FIG. 3.

The primary and secondary linear force actuators 14 and 15 preferably are of the cylinder and piston type and are hydraulically operated. The cylinders of the actuators 14 and 15 are associated with the fixed head assembly 11, while the rods 54 of the actuators extend to the movable head assembly 12. The primary actuators 14 are supported in associated gimbal reaction assemblies 51 which provide for pivotal movement about a horizontal axis on trunnions 52 and about a vertical axis on trunnions 53. The rods 54 of the primary actuators 14 are threaded or otherwise fixed to rod ends 55 of the universal type.

Figure 7:
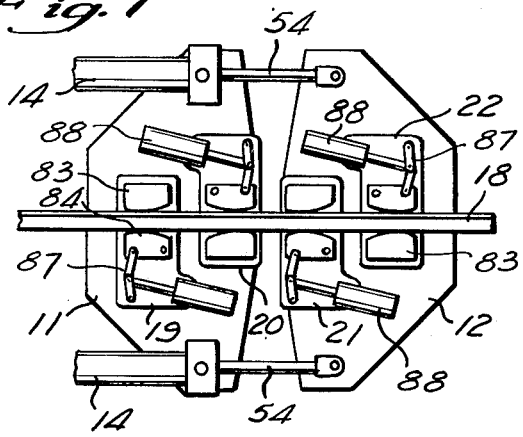
FIGS. 7 through 10 illustrate a typical sequence of operation in the bending and feeding of a beam.
Figure 8:
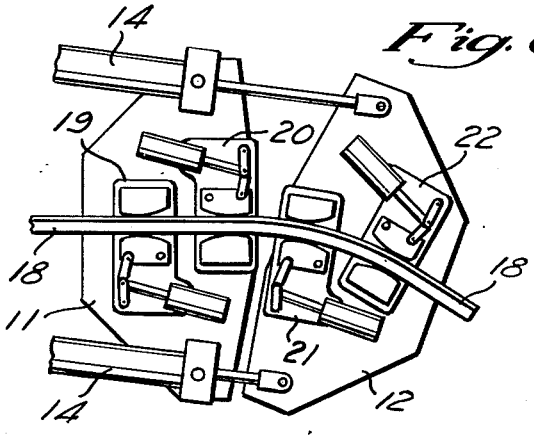

The rod ends 55 are mounted in circular reaction posts 56 fixed to the head plates 25 and 26 in mounting holes 57 corresponding to those formed in the plates 25 and 26 associated with the trunnions 53. As shown, the lateral spacing of the trunnions or cylinder reaction members 53 and the reaction posts 56 from the central, vertical plane of symmetry of the plates 25 and 26 is substantially equal. Thus, as shown in FIG. 7, the actuators 14 are substantially parallel to one another and the longitudinal axis of an initially straight beam. Additionally, the primary actuators 14 and the beam 18 lie in a horizontal plane equidistant from the plates 25 and 26, which is hereinafter simply referred to as the principal plane of the heads or beam.

The secondary actuators 15 are arranged in a plane perpendicular to the principal plane of the primary actuators 14 and are gimbaled in reaction assemblies 60. The gimbal assemblies 60 provide for pivotal movement about a vertical axis on trunnions 61 and pivotal movement about a horizontal axis on trunnions 62. The horizontal trunnions 62 of each gimbal assembly 60 are supported in spaced angle brackets 64, which are secured to the associated bending head plates 25 and 26 by bolts 65. The piston rods, designated 67, of the actuators 15 extend to universal rod ends 68 mounted on vertical pins 69 in reaction blocks 70. A pair of laterally spaced angle brackets 73 are provided for supporting each of the reaction blocks 70 on the movable head assembly 12. The brackets 73 are fixed to their associated bending head plates 25 and 26 by bolts 74.

Referring particularly to FIG. 6, the clamping assemblies 19 through 22 are provided in pairs on each of the bending heads 11 and 12. Each of the clamping assemblies 19 through 22 is of substantially identical L-shaped structure, but on each head assembly 11 and 12 the assemblies are arranged head to tail to save space. The assemblies 19 through 22 include parallel, horizontally oriented, upper and lower plates 76 and 77, respectively. An upper plate 76 is shown with the leftward clamping assembly 19, while such plate is removed in the other assemblies 20 through 22 to reveal their lower plates 77 and schematic details of the clamping mechanism.

The upper and lower plates 76 and 77 of each assembly are rigidly connected by means (not shown) such as spacer blocks. Each assembly 19 through 22 is pivotal on vertical trunnions 79, which define vertical pivot axes for the assemblies along lines passing through the beam 18. In the case of the inner clamping assemblies 20 and 21, each trunnion axis is coincident with the axis of the vertical trunnion 61 of the secondary actuators 15. The clamping assembly trunnions 79 are received in bushings 80 bolted to the bending head plates 25 and 26. The clamping assemblies 19 through 22 are omitted from the showing in FIG. 3 for the sake of simplicity and it will be understood that they are disposed between the upper and lower plates 25 and 26 and are adapted to swing on their associated trunnions 79 in the plane of their respective heads.

Each clamping assembly 19 through 22 includes a beam gripping jaw 83 fixed between its respective plates 76 and 77, and an oppositely facing jaw 84 pivotal between such plates. The beam engaging surfaces, designated 85 and 86, of the fixed and movable jaws are arcuately formed on a radius of curvature slightly less than the minimum expected radius of curvature to be imparted to the beam 18. Ideally, the centers of curvature of the fixed jaw surface 85 and the pivotal jaw surface 86, when it is engaging the beam, lie along a common line extending through the vertical axis defined by the trunnions 79. With the radius of curvature of the beam engaging jaw surfaces 85, 86 equal to the minimum bend radius, these surfaces allow the beam to reach such a radius and provide less unit contact pressure than would be present where shorter radii were used.

Each clamping assembly 19–22 includes a toggle mechanism 87 and a piston and cylinder actuator 88 for selectively opening and clamping the pivotal jaw 84, to forcibly grip the beam 18. The actual configuration of the jaws 83, 84 is selected to suit a particular beam cross section. As shown in FIG. 13, for example, one or more jaws 83 or 84 may include at least two beam engaging surfaces, one engaging a first leg of an angle section, and another engaging the second line of the angle. Ideally, the jaws 83, 84 are arranged to support the beam 18 with its neutral axis at or near the intersection of the vertical and horizontal planes of symmetry of the heads 11 and 12.

Figure 5:
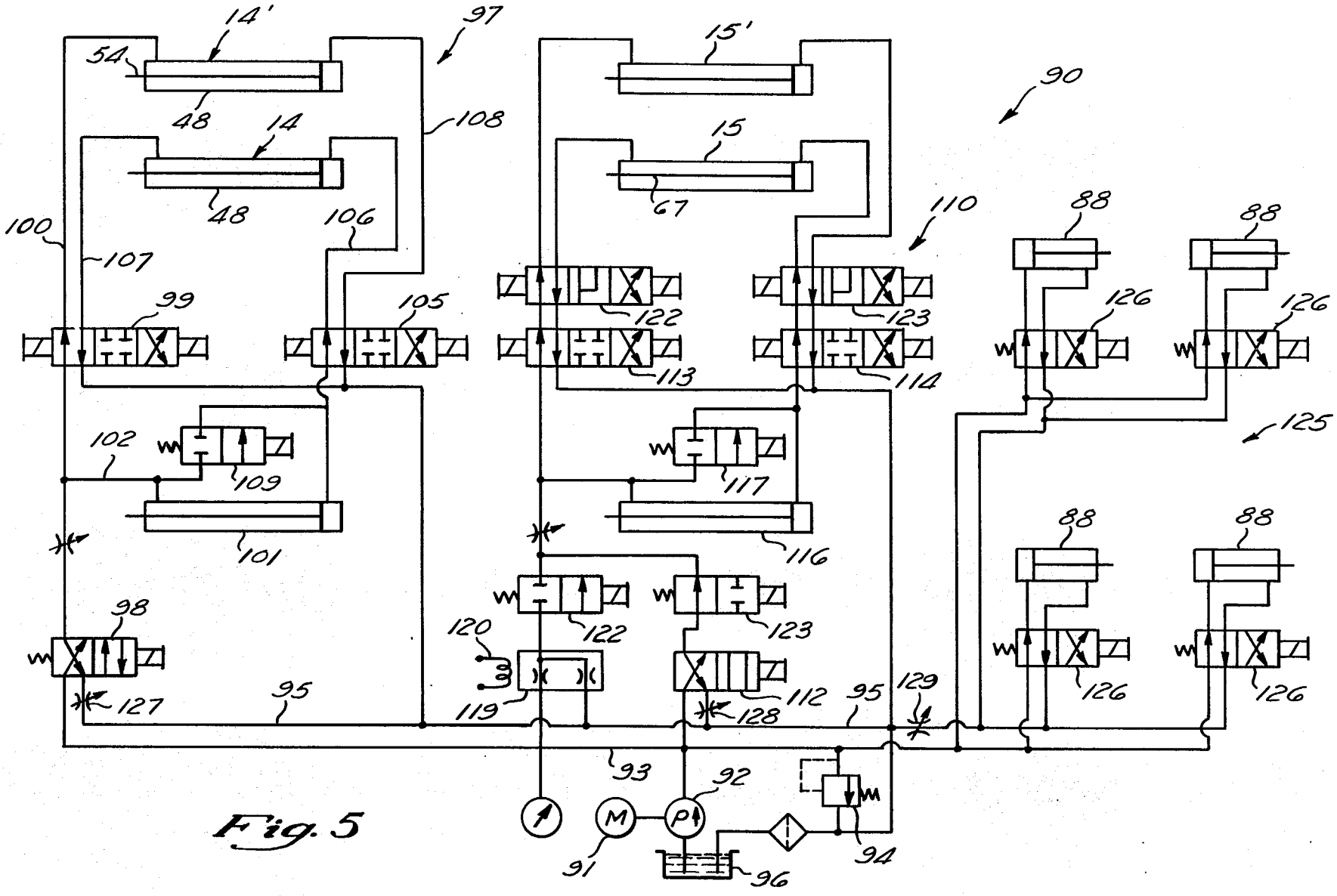
FIG. 5 is a schematic diagram of a hydraulic control circuit for energizing the disclosed beam bending apparatus.

As is set out in greater detail below, a beam is bent by rotating the movable head assembly 12 relative to the fixed head assembly 11 in the principal plane of the heads and, depending upon the beam cross section, possibly in a vertical or secondary plane. This motion is developed by the principal and secondary actuators 14 and 15, respectively. FIG. 5 illustrates a circuit 90 for controlling these actuators 14, 15 and the clamping actuators 88 during a process of feeding and bending a beam. The primary actuators 14 and their related circuitry are shown in a subcircuit 97 at the left-hand portion of FIG. 5. The secondary actuators 15 and an associated subcircuit 110 are shown in the center portion of FIG. 5. Finally, the clamping cylinders 88 and related subcircuit 125 are shown at the right-hand of FIG. 5.

A motor 91 drives a pump 92, which supplies pressurized hydraulic fluid to a supply line 93. The line 93 distributes fluid under pressure, limited by a regulator 94, to the subcircuits 97, 110, and 125. Fluid from various portions of the control circuit 90 follows a return line 95 to a reservoir 96 of the pump 92.

A control valve 98, in the illustrated position, maintains the lines associated with the subcircuit 97 at atmospheric pressure during periods of inactivity for purposes of safety. When shifted to the right from the illustrated position, the control valve 98 connects the pressure line 93 to the actuator 14' through a first reversing valve 99 and a line 100 and to the rod chamber of a force equalizing piston and cylinder 101 through a line 102. Fluid at the piston chamber of the force equalizing cylinder 101 is connected by a second reversing valve 105 to the piston chamber of the other primary actuator 14 through a line 106. In the illustrated position of the reversing valves 99 and 105, the rod chamber of the primary actuator 14 is connected to drain, i.e., the reservoir 96, through a line 107, and the piston chamber of the primary actuator 14' is connected to drain through a line 108.

The valves illustrated in FIG. 5, with the exception of a servo valve, discussed below, may be conveniently operated either electrically or manually. With the first control valve 98 shifted leftwardly and the reversing valves 99 and 105 in the illustrated positions, fluid flow causes the rod 54 of the actuator 14' to retract and the rod 54 of the actuator 14 to extend. As can be seen from the figures, retraction of one of the actuators 14 and extension of the other will cause the movable head assembly 12 to rotate in a horizontal plane relative to the stationary head assembly 11. Rotation in an opposite direction is accomplished by shifting the reversing valves 99 and 105 to their extreme leftward positions, in which case, flow from the valve 98 is directed through the line 107 to retract the actuator 14. Simultaneously, fluid is forced by pressure in line 102 from the piston chamber of the force balancing cylinder 101 through line 108 to extend the piston rod of actuator 14'. The piston chamber end of actuator 14 is exhausted through line 106 and the rod chamber of actuator 14' is exhausted through line 100.

Study of the subcircuit 97 reveals that the force balancing cylinder 101 has its rod end connected to the rod end of one actuator and its piston chamber to the piston chamber of the other actuator in either of the positions of the reversing valves 99 or 105. The cylinders and rods of the actuators 14, 14' and the force equalizing cylinder 101 are equal so that, for equilibrium on the piston of the force balancing cylinder, the forces developed by both of the actuators 14 and 14' are equal and opposite.

To recharge the piston chamber of the force equalizing cylinder 101, a valve 109 is shifted from its illustrated position leftwardly. In its leftward position, the valve 109 equalizes the pressure on both sides of the piston of cylinder 101 so that its rod and piston are moved leftwardly due to the pressure area differential on the piston due to the rod cross section. The middle positions of the reversing valves 99 and 105 are used during the recharging operation.

The circuitry 97 just described in connection with the primary actuating cylinders 14 is reproduced in subcircuit 110 for controlling the secondary actuating cylinders 15. Under manual or electrical operation, a valve 112, the equivalent of control valve 98, drives the secondary actuators 15 in directions determined by the positions of reversing valves 113 and 14, which are the equivalents of previously discussed valves 99 and 105. Flow to the piston chambers of the actuators 15 is again provided by a force balancing piston and cylinder 116, which in turn may be recharged by a valve 117 in a manner discussed above with elements 101 and 109, respectively. The diameters of the cylinders and rods of the actuators 15 and piston and cylinder 116 are equal. The reversing valves 113 and 114 are, again, moved to their center positions during recharging of the piston and cylinder 116 by the valve 117. Movement of the valves 113 and 114 to their leftward positions again reverses the direction of movement of the piston rods in the actuators 15.

A servo valve 119 may be used as an alternative to the use of the manual valve 112. The servo valve 119, of known construction, is adapted to automatically develop a pressure in the subcircuit 110 in a desired proportion to that existing in the primary subcircuit 97 so that the force developed in the secondary actuators 15 is a known proportion of that developed by the primary actuators 14. This is accomplished, for example, by electronically measuring the force in the rods of the actuators 14 and 15, as by strain gauges, comparing these signals with a set point and using the error signal to drive a coil 120 of the servo valve 119 in accordance with conventional servo control techniques. During automatic or servo operation of the subcircuit 110, a pair of valves 122 and 123 are moved in unison to their leftward positions to provide a proper flow path. The reason for the desirability of producing a proportional force in the actuators 14 and 15 is explained hereinbelow.

By driving the piston rods 67 of the secondary actuators 15 both simultaneously in the same direction, the movable head 12 may be advanced or retracted relative to the stationary head 11. This is accomplished in the subcircuit 110 by shifting a pair of valves 122 and 123 to their mid positions and putting only one or the other of the reversing valves 113 and 114 in its reversing or leftward position. More specifically, moving only the valve 114 to its leftward position allows the secondary actuator piston rods 67 to retract while, alternatively, moving only the valve 113 to its leftward position allows these rods to extend, to thereby advance the head 12.

Figure 9:
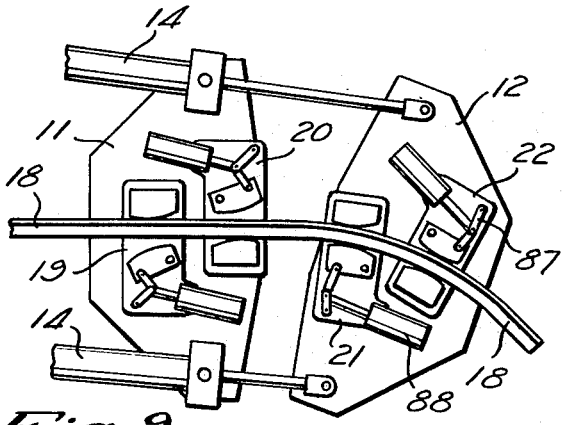
Figure 10:
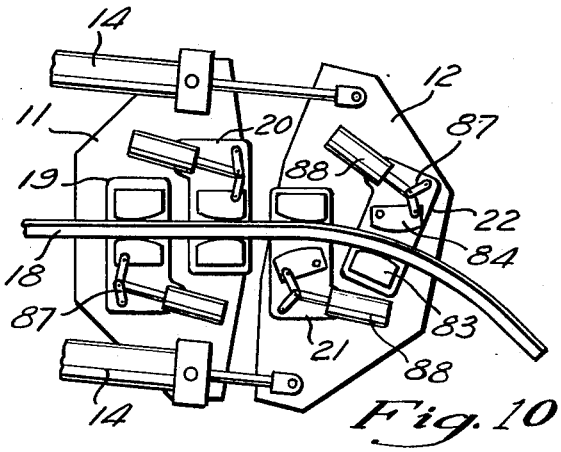

In subcircuit 125 each of the four clamping cylinders 88 includes a separate two-position valve 126. In their normal illustrated positions, the valves maintain the rods of their associated cylinders 88 extended. In their leftward positions, the valves 126 cause the rods to retract. As indicated in FIG. 9, retraction of the rods of the cylinders 88 causes the associated jaws 84 to be toggled closed and extension of the rods causes the jaws 84 to be opened. A flow restrictor 127–129 is provided in each of the subcircuits 105, 110, and 125 to prevent shock loading when the subcircuits are unloaded.

In operation, a beam 18 is positioned endwise through the clamping assemblies 19–22, and the portion of the beam to be bent is positioned in a work area between the inner pair of assemblies 20 and 21 (FIG. 7). The valves 126 associated with the clamping cylinders 88 are shifted from their normal positions to retract the rods of the cylinders 88 and close the jaws 84 laterally against the beam 18. As shown, the jaws operate in the horizontal or principal plane of bending. The reversing valves 99 and 105 are positioned to cause clockwise or counterclockwise rotation of the movable bending head 12, as desired, the former being illustrated in the figures. The valve 98 is then shifted from its normal position to drive the primary actuators 14 in the desired opposite directions.

Equal and opposite piston forces developed by the actuators 14 produce a force couple on the heads 11 and 12, which is transferred from the heads to the beam through the jaw surfaces 85 and 86, so that the couple develops a bending moment of the same magnitude on the beam in the work area. The valve 98 is maintained in the leftward or driving position, and the actuators 14 are driven until the beam is plastically deformed and the desired angular displacement in the beam is achieved.

After the beam is bent, the control valve 98 is returned to its normal illustrated position to unload the pressure in the actuators 14 and the clamping valves 126 are returned to normal position to open the clamping assemblies 19 through 22.

The bend angle may be determined visually, or by other conventional techniques. A convenient manner of measuring the bend in the beam is illustrated in FIG. 15. A transducer 141, ideally in the form of a precision rotary potentiometer, has its shaft 142 fixed to a vertical trunnion 61 of one of the secondary actuators 15. The body of the transducer 141 is fixed relative to the bending head 11 such that horizontal rotational deflection of the secondary actuator 15 on its vertical trunnions 61 from the longitudinal axis of the beam, indicated at 143 in FIG. 15, is measured by the potentiometer as a change in resistance representing the angle $\theta$.

The angle $\theta$ has the following identity:

$$\theta = \theta_o + \frac{(4+l)_M}{EI} + \frac{l}{2\rho}$$

where:

$\theta_0$ — the initial rotation of the sensor due to the curvature of the beam in the moving head, $l$ — the work length, $\rho$ — the plastic radius of curvature in the work length $M$ — the applied amount or couple which, ignoring friction, is equal to the pressure area product in either of the principal actuators 14 times the distance between the actuators, $EI$ — the elastic stiffness of the beam.

The second term on the right-hand side of the above equation represents the elastic bending in the beam, which is the anticipated springback, while the last term represents the plastic or permanent angular deformation. When $\theta$ is measured by the potentiometer 141, the equation may be inverted to yield $\rho$, the radius of curvature in the work area of the beam.

A typical sequence of operations is shown in FIGS. 7 through 10, where a beam is bent along its length by successively bending adjacent areas. After being loaded and clamped in the assemblies 19 through 22, a straight beam 18 is bent, as above described, by rotating the movable head to a position illustrated in FIG. 8, which is essentially the same as that shown in FIG. 6. The beam 18 is then advanced or fed longitudinally through the fixed head 11 by moving the head 12 in translation. This action is conveniently accomplished by causing the piston rods 67 of both of the secondary actuators to advance or extend in the manner discussed in connection with the valves 122 and 123 of subcircuit 110. During this period, the clamping assemblies 19 and 20 of the fixed head are opened, while the other clamping assemblies 21 and 22 are closed. Following this feed stroke of the movable head 12, the fixed head clamping assemblies 19 and 20 are closed, while the movable head clamping assemblies 21 and 22 are opened. The movable head 12 is then retracted towards the fixed head 11 by switching the positions of the valves 113 and 114 opposite those used for advancing the cylinders 15. During these feeding and retracting operations, the control valve 98, in its normal position, allows the primary actuators 14 to float and offer negligible resistance to movement.

When the beam 18 being bent is rectangular in cross section, or is otherwise symmetrical with the principal plane of bending, as in the case of a T-bar being bent in the plane of its stem, a bending couple need only be applied in the principal plane of bending. Where the cross section of the beam is not symmetrical with the principal or desired plane of bending, as in the case of an angle iron or Z section, a secondary bending moment should be applied to the beam in a plane perpendicular to the principal bending plane to satisfy internal force equilibrium conditions in the beam and maintain the beam in the desired principal plane.

Figure 2:
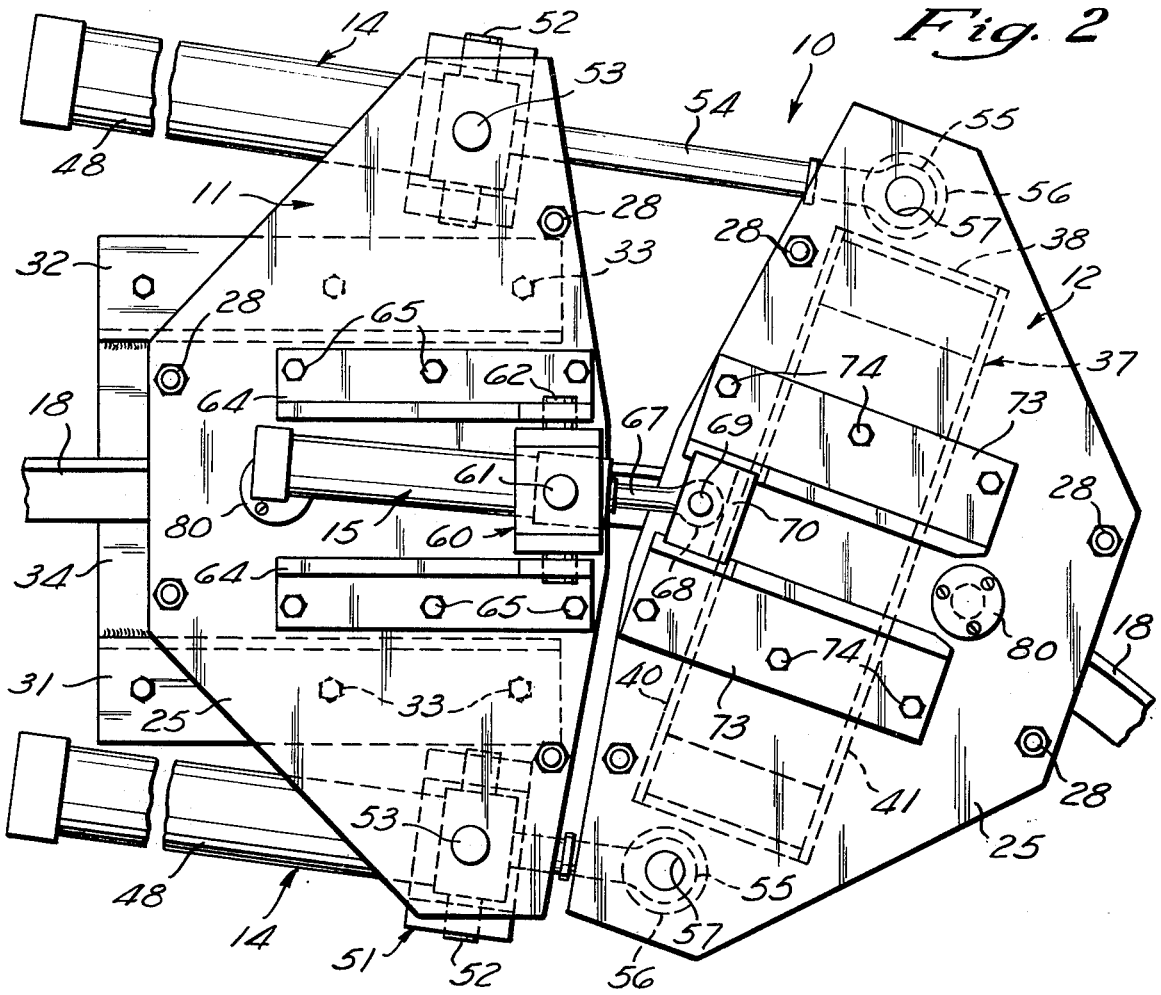
FIG. 2 is a plan view of the bending apparatus of FIG. 1.

For example, in the case of the angle cross section beam illustrated in FIG. 2, where the bending head 12 has been rotated clockwise and the angle section beam is oriented as illustrated, the bending head would, without an auxiliary applied moment, be forced upwardly out of the plane of the fixed head. The auxiliary actuators 15 are provided to eliminate this difficulty and ultimately produce a beam having a single plane of bending, regardless of cross sectional configuration. The actuators 15, under the manual valve 112 or servo valve 119, are employed to rotate the head 12 in a vertical or secondary plane in a direction opposite that in which the beam tends to deflect.

The angle through which the moving head 12 is rotated in the secondary plane may be measured by a technique schematically illustrated in FIG. 16. The actuators 15 are each provided with a precision rotary potentiometer 146 and 147 having its body fixed to its respective actuator. A shaft 148, 149 of each potentiometer 146 and 147 is fixed to an associated pulley 151 and 152 having a cable 153 and 154 wound on it. Each cable 153 and 154 is fixed on a forward end of the adjacent piston rod 67. Springs (not shown) are provided to bias the pulleys 151 and 152 in an angular direction for taking up its cable 153 or 154. The spring force is negligible in comparison to the magnitude of the beam bending forces in the rods 67. The angle $\psi$ is given in the following equation:

$$\psi = 2 \sin^{-1} \left(\frac{l_1 - l_2}{24}\right)$$

where:

$l_1$ — length of first rod extension $l_2$ — length of second rod extension $\psi$ — out-of-plane deviation in radians.

With the diameter of the pulleys 151 and 152 and the resistance characteristics of the potentiometers 146 and 147 known, lengths or changes in lengths of $l_1$ and $l_2$ may be measured electrically.

As in the case of bending in the principal plane by the primary actuators 14, the bending moment developed in the secondary or vertical plane is equal to the force couple developed by the secondary actuators 15. This force couple is, again, equal to the pressure area product in the secondary actuators 15 multiplied by the distance between the actuators. The relative magnitude of the secondary force couple to the magnitude of the principal force couple depends on the cross sectional geometry of the beam being bent. Where the desired ratio between these relative magnitudes is known, controls associated with the servo valve 119 and its coil 120 may be adjusted to produce such a ratio automatically.

The resultant couple to which the beam is subjected lies in a longitudinal plane at an angle offset from the principal plane towards the secondary plane. For example, where the secondary bending moment was relatively small, the resultant couple would be in a plane relatively close to the principal plane; and where the secondary couple was approximately equal to the principal couple, the resultant couple would lie in a plane at approximately 45° to the principal plane, i.e., midway between the principal and secondary longitudinal planes. Thus, by adjusting the relative magnitudes of the couples developed by the primary and secondary actuators 14 and 15, the plane of the resultant couple may be rotated relative to the horizontal plane of the heads 11 and 12.

Referring now to FIGS. 11 through 14, means are provided for preventing buckling of a web, flange, or other beam portion which is subjected to local compression during the bending load. In FIGS. 11 and 12, a pair of restraining members 161 and 162 are placed against a leg 163 of the beam 18, which extends perpendicularly to the desired plane of bending which is the plane of the drawing in FIG. 11. The members 161 and 162 are positioned in abutting engagement with the surfaces of the angle leg 163 and extend longitudinally through the work area between the inner pair of clamping members 20 and 21 to the outer clamping assemblies 19 and 22. The restraining members 161 and 162 are rigid, flexible bodies, preferably made of fiber glass-reinforced plastic. The members 161, 162 resist buckling in the work area by preventing local displacement or deformation of the angle leg 163 out of its plane.

FIGS. 13 and 14 illustrate a restraining element 166 in the form of a rigid channel. Opposed legs of the channel 167 are spaced apart a sufficient distance to provide a slip fit on an angle leg 165 subjected to bending in its own plane. The restraining channel 166 is made of a rigid, relatively stiff material, such as steel, to resist local buckling deformation of the leg 165 in compression between the inner clamping assemblies 20 and 21. As illustrated in FIG. 13, the clamping assemblies 19 through 22 may be arranged to allow for clearance of the restraining channel 166 in the work area so that it need not be bent with the beam 18.

The disclosed physical arrangement, wherein the cylinders of the primary and secondary actuators 14 and 15 are associated with the fixed head, is advantageous because the cylinders are aligned with the unworked or straight portion of the beam 18, and therefore do not interfere with it. The disclosed placement of the gimbal assemblies 51 and 60 as close as possible longitudinally to the work area and laterally to the longitudinal axis of the beam minimizes the necessary extension of a piston rod for a given rotation of the movable head 12, and thereby minimizes the buckling tendency of the rod when it is in compression. The coincidence of the axes of the vertical trunnions 61 and the vertical reaction pins 69 with the vertical pivot axes of the inner clamping assemblies 20 and 21 allows for ready measurement of the angular displacement of the movable head 12 by measurement of the angular displacement of a vertical trunnion 61 relative to its head 11, as previously discussed.

It can be seen that the resultant couple developed by the principal and secondary actuators 14 and 15, applied to the beam through the clamping assemblies 19 through 22 as the movable head 12 is rotated relative to the fixed head, does not transversely load the beam in the work area. The absence of transverse or shear stress in the beam in this area avoids unintentional and unwanted twist in the beam. The force couple transferred to the beam by the heads 11 and 12 also avoids introduction of axial loading, either in compression or tension, separate from the local tensile and compressive stresses developed by the bending moment itself. The pure bending moment and absence of transverse loading also tend to avoid plastic hinge deformation, and produce a uniform curvature in the work area.

Although a preferred embodiment of the invention has been shown and described in detail, it is to be understood that various modifications and rearrangements of parts may be resorted to without departing from the scope of the invention.

We claim:

1. A method of bending a beam comprising the steps of providing a beam having a nonsymmetrical cross section with respect to a first axial plane, laterally engaging the beam at two spaced points with surfaces provided on a pair of longitudinally spaced bending heads, applying a force couple on one of the heads, with sufficient magnitude to cause rotation of the one head relative to the other, in a longitudinal plane oriented from said first axial plane and a second axial plane perpendicular to said first axial plane and having an orientation determined by the cross section of the beam whereby a permanent deflection of the beam is produced solely in said first axial plane.

2. A method as set forth in claim 1, wherein said couple is applied without transversely loading the beam in a work area between said zones.

3. A method as set forth in claim 2, wherein said couple is applied without axially loading the beam in said work area.

4. A method of bending a beam comprising the steps of providing a beam having a nonsymmetrical cross section with respect to a first axial plane, transversely engaging the beam with surfaces provided on a pair of longitudinally spaced bending heads, supporting the heads and beam in a manner to permit rotation of one of said bending heads relative to the other, in a longitudinal plane oriented from said first axial plane and a second axial plane perpendicular to said first axial plane and having an orientation determined by the beam cross section, without significantly transversely loading said beam in a work area between said heads when said heads are rotated relative to one another through a substantial angle, and rotating said one head relative to the other to cause said beam to be permanently bent solely in said first axial plane.

5. A method as set forth in claim 4, wherein said heads and beam are supported in a manner to permit rotation of said one bending head without axially loading said beam in said work area.

6. A method as set forth in claim 5, wherein said one head is rotated by applying a force couple on it.

7. A method as set forth in claim 6, wherein said force couple is developed by force actuator means connected directly between said heads.

8. A method of permanently bending a beam in a desired plane, the cross section of the beam being nonsymmetrical with respect to said desired plane, comprising the steps of laterally engaging surfaces of the beam at longitudinally spaced points along the beam with gripping surfaces of a pair of spaced bending heads, providing on each of the bending heads a first pair of lateral extensions on opposite sides of the beam in a first plane and an associated first pair of linear force actuators connected between said extensions and substantially parallel to the longitudinal axis of the beam, providing on each of the bending heads a second pair of lateral extensions on opposite sides of the beam in a second plane perpendicular to said first plane and an associated second pair of linear force actuators connected between said extensions and substantially parallel to the longitudinal axis of the beam, and simultaneously applying opposite forces in each pair of force actuators to rotate said bending heads in said first and second planes with sufficient amplitude to permanently deform the beam in the desired plane.

9. A method as set forth in claim 8, wherein the force in each pair of said actuators is equalized hydraulically.

10. A method as set forth in claim 8, wherein said beam is bent at successive areas along its length and the beam is advanced between such areas by a stroke developed by one pair of said linear force actuators.

11. A method as set forth in claim 8, wherein a longitudinally extending portion of the beam in a work area between said heads is supported against localized buckling by restraining surface means in abutting engagement with said beam portion.

12. A method of bending a beam in a desired axial plane with which the cross section of the beam is nonsymmetrical, comprising the steps of providing a beam having a nonsymmetrical cross section, laterally gripping the beam with two longitudinally spaced heads, rotating one of the heads relative to the other by applying a bending moment to the one head in a longitudinal plane oriented out of the desired axial plane of bending and a second axial plane perpendicular to said desired axial plane in a manner such that the beam is plastically deformed in a work area between said heads solely in the desired axial plane of bending.

13. A method as set forth in claim 12, wherein said bending moment is applied as the resultant of two moments applied separately to the said one head in perpendicular planes.

14. A method as set forth in claim 13, wherein the angle between the resultant moment plane and the desired bending plane is adjusted by varying the relative magnitudes of said perpendicular separately applied moments.

15. A method as set forth in claim 14, wherein said separately applied moments are developed as force couples.

16. A method of bending a beam in a desired axial plane with which the cross section of the beam is nonsymmetrical, which comprises the steps of providing a beam having a nonsymmetrical cross section, simultaneously applying, through surfaces spaced along the axis of the beam, a pair of bending moments in first and second longitudinal planes perpendicular to each other to produce a resultant bending moment on the beam in a work area between said spaced surfaces in a third longitudinal plane oriented out of the axial plane of desired bending.

* * * * *